United States Patent [19]

Brown

[11] 4,183,526

[45] Jan. 15, 1980

[54] TENNIS TRAINING DEVICE

[76] Inventor: Donald K. Brown, 1662 Maryland, Birmingham, Mich. 48009

[21] Appl. No.: 868,271

[22] Filed: Jan. 10, 1978

[51] Int. Cl.[2] ..... A63B 61/00

[52] U.S. Cl. ..... 273/29 A; 273/73 R; 273/DIG. 4

[58] Field of Search ..... 273/29 R, 29 A, 67 R, 273/67 A, 73 R, 73 J, 73 C, 73 H, 76, 75; 224/5 D, 7 R

[56] References Cited

U.S. PATENT DOCUMENTS

| | | | |
|---|---|---|---|
| 226,206 | 1/1973 | Rankin, Jr. | 273/76 R UX |
| 1,536,255 | 5/1925 | Beal | 273/73 R |
| 2,801,105 | 7/1957 | Acton | 273/73 R |
| 2,932,514 | 4/1960 | Bergmark | 273/73 R |
| 3,801,099 | 4/1974 | Lair | 273/73 C |
| 3,848,871 | 11/1974 | Sweet | 273/75 |
| 3,921,978 | 11/1975 | Warren | 273/67 R |
| 3,934,876 | 1/1976 | Haddad | 273/76 |
| 3,994,495 | 11/1976 | Stoffel | 273/73 R |
| 4,062,541 | 12/1977 | Marks | 273/73 R |

FOREIGN PATENT DOCUMENTS

| | | | |
|---|---|---|---|
| 178843 | 6/1954 | Fed. Rep. of Germany | 273/76 R |
| 2445877 | 4/1976 | Fed. Rep. of Germany | 273/75 |
| 607255 | 8/1948 | United Kingdom | 273/76 |
| 734214 | 7/1955 | United Kingdom | 273/73 R |

*Primary Examiner*—Richard C. Pinkham
*Assistant Examiner*—T. Brown
*Attorney, Agent, or Firm*—Fisher, Gerhardt & Groh

[57] ABSTRACT

A tennis training device is provided which has a head portion comprising a lightweight plastic foam material, a handle member and a grip affixed to the handle. The overall weight of the tennis training device is distributed so as to simulate the balance of a conventional tennis racket. The grip includes finger placement guides so oriented as to train the player in the eastern forehand type of grip. The air resistance of the head when swinging the tennis racket forces the player to utilize shoulder action in his swing thereby conditioning the player in proper tennis form with an objective of minimizing one of the contributing causes of "tennis elbow." When used in conjunction with a lightweight spongy game ball, the tennis training device is particularly suited for indoor use. Additionally, a retaining device is provided attachable to the handle of the tennis trainer and adapted to receive a companion game ball.

3 Claims, 6 Drawing Figures

TENNIS TRAINING DEVICE

The game of tennis has been a popular sport for many years and is presently enjoying increased interest as witnessed by the proliferation of indoor and outdoor tennis courts. As a form of physical exercise, tennis is highly recommended by experts in the health field because it is an active sport which can be enjoyed by individuals of all age groups and, additionally, requires only a minimal outlay for equipment.

Assuming proper physical conditioning, there remain some aspects of the game in which poor playing technique will lead to physical problems. One such problem is the malady commonly known as "tennis elbow," which is partially due to improper racket handling technique. Even experienced tennis players occasionally develop this condition, but it can be overcome by proper training. Nonetheless, it would be highly beneficial for the novice to be able to train himself in the proper grip without professional tennis lessons.

For those who wish to become proficient at tennis, regular practice is mandatory to acquire the requisite skill and coordination. Outdoor courts are generally unavailable during inclement weather and often indoor courts are crowded and sometimes beyond the financial resources of many tennis players. Practicing tennis within the home with a standard racket and tennis ball is undesirable alternative to outdoor play because of the danger of marring walls and breaking windows and other fragile objects, as well as causing a considerable amount of noise.

The present invention relates to a tennis training device so designed as to compel the novice and the experienced tennis player to utilize shoulder action in his swing as opposed to the common tendency toward using excessive wrist action. Frequent practice with this device teaches proper racket handling techniques and minimizes one of the major causes of "tennis elbow." When used in conjunction with a spongy lightweight game ball, the present invention may be safely used within a confined space, such as a room in the home, without much danger of breaking windows or marring walls or furniture. Having the same general configuration, weight distribution and length of a standard tennis racket, the tennis trainer permits the player to acquire the same eye and body coordination as utilized in the regular tennis game with regulation equipment, so that a player may alternate between practice and regular play without losing his "feel" for the game.

An object of the present invention is to provide a tennis trainer which teaches proper racket gripping technique.

Another object of the invention is to provide a tennis trainer having a grip portion oriented so as to force the user to use shoulder action.

A further object of the invention is to provide a tennis trainer which is of the same length, weight distribution, and general configuration of a regulation tennis racket.

A still further object of the present invention is to provide a tennis trainer which may be conveniently used indoors.

Yet another object of the invention is to provide a tennis trainer having a removable retaining clip which may be used to store a compressible game ball.

A general object of the invention is to provide a tennis trainer capable of being manufactured and made commercially available in a relatively inexpensive manner, yet durable enough to have a long effective operating life.

More specifically, the present invention contemplates a tennis training device comprising a head portion made up of a plastic material and having a shank member insertable therein and adhesively secured thereto. A grip portion is provided which has finger placement means oriented coplanar to a lateral side of the head portion so as to permit only one comfortable gripping position. In order to prevent the companion practice tennis ball of compressible material from becoming separated from the racket in storage, a retaining clip is provided which snaps over the shank member of the racket and has an extending semi-circular portion adapted to securely receive the practice tennis ball.

Various other objects and advantages of the present invention will be readily apparent from the following description and from the drawings in which exemplary embodiments of the invention are shown.

Figure 1:
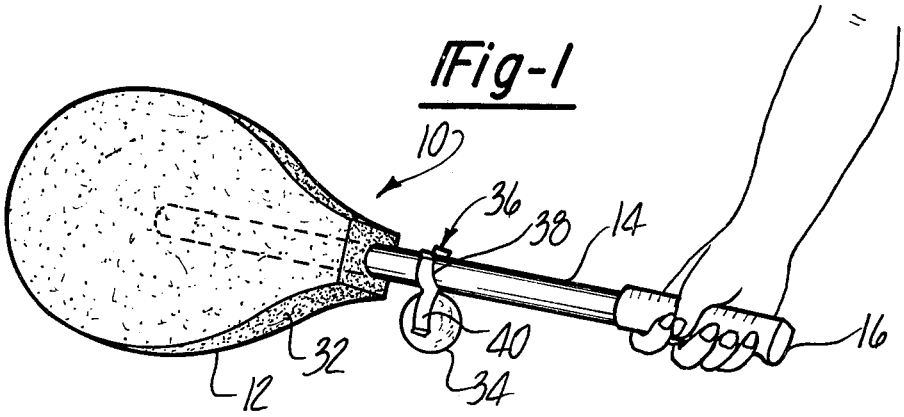
FIG. 1 is a perspective view of the present invention.
Figure 2:
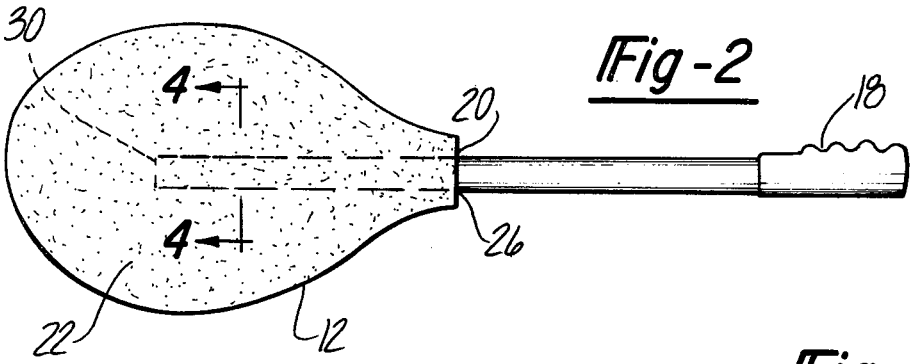
FIG. 2 is a plan view of the tennis training device.

A preferred example of the present invention is illustrated in FIG. 1 wherein a tennis training device is generally indicated by the reference numeral 10. Basically, the tennis training device includes a head portion 12, a handle member 14 and a grip 16 having finger placement guides 18.

In detail, the head portion 12 may comprise a rigid foam plastic material with the preferred material being foam polyethylene. Foam polyurethane is an equally satisfactory material in that it is sturdy, lightweight and water repellant. These substances have greater impact resistance and puncture resistance than foamed plastics in the nature of polystyrene which tend to crumble or deform when struck a glancing blow. The head portion 12 preferably has the same general dimensions as the corresponding head portion of a regulation tennis racket; that is, the same basic shape, length and width. However the thickness will be greater than a conventional racket due to the expanded cellular nature of the low density material used. The head 12 may be cut from a sheet of stock foam material by means of a jigsaw, hotknife or other conventional means. Also, an injection molding process is a suitable production method for large quantities and has other advantages as discussed below.

Figure 5:
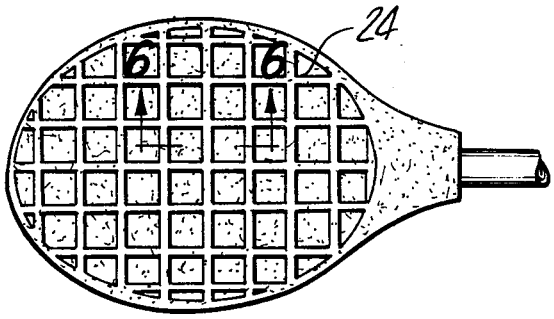
FIG. 5 is a fragmentary plan view illustrating a modification of the face of the tennis training device.
Figure 6:
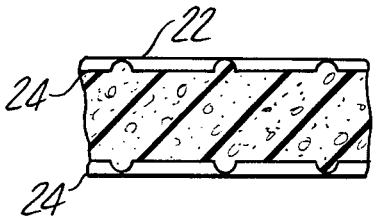
FIG. 6 is an enlarged cross-sectional view taken along line 6—6 of FIG. 5.

Centrally located and inwardly directed from the base of the head portion 12 is an elongated annular recess, extending approximately eight inches into the body of the head portion 12 and having a diameter slightly less than that of the handle member 14. In the preferred embodiment, the face 22, or playing surface, of the head portion is shown having a solid planar surface. If desired, the appearance of a standard stringed tennis racket may be simulated thereon by silk screening or embossing. If an injection molding process is used to form the head, selected surfaces of the interior face of the mold may be provided with the desired pattern 24. Such a pattern is illustrated in FIGS. 5 and 6.

It is contemplated that a head portion formed by an injection molding process and having a greater density than an expanded foam plastic head may have a somewhat thinner profile. To effect weight reduction and weight distribution, there may be provided an enlarged circumferential rim having appropriate hollow or open areas therein and surrounding a comparatively flat, solid central area corresponding to the webbed portion of a conventional stringed tennis racket.

A significant advantage of the present invention as a training or practice device is that its balance point 26 is located at the juncture of the head 12 and shank 14 corresponding to the balance point of a regulation tennis racket.

A handle member 14 is provided which may comprise a rigid hollow polyethylene tube having an outside diameter slightly larger than the recess 20 provided in the head portion 12. As the foam material of the head portion 12 is slightly compressible, this allows the handle or shank 14 to be insertable into the elongated recess 20 disposed between the opposed parallel spaced ball engaging surfaces 22, in frictional, snug-fitting relationship with the inner walls 28 of the recess. A satisfactory fit is achieved with the diameter of the recess 20 being approximately twenty percent smaller than the outside diameter of the shank member which in turn must be smaller than the thickness of head 12. This ratio is applicable when the head member 12 is constructed of low density foam polyethylene and the shank member 14 is constructed of substantially higher density rigid polyethylene. With other construction materials, the proper parameters may be readily ascertained. Before assembly, however, a suitable adhesive is applied to the inner walls 28 of the recess 20, and the open end of the shank 14 is provided with a protective cap or tape 30 precluding excess adhesive from flowing into the inside of the hollow shank. Such leakage is unsightly, may leave inadequate adhesive for proper bonding and may effect the balance of the device if excessive.

Figure 3:
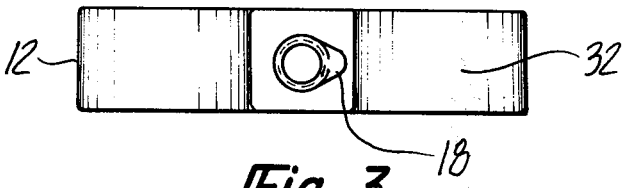
FIG. 3 is an end view of the tennis training device showing the orientation of the grip.
Figure 4:
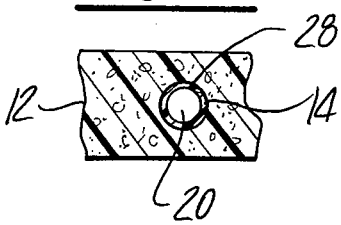
FIG. 4 is a cross-sectional view taken along line 4—4 of FIG. 2.

Opposite the head portion of the shank 14 is provided a grip member 16 having raised portions integral therewith serving as finger placement guides 18. The grip member 16 may be of the kind generally used on bicycle handle bars, composed of an elastomeric or plastic material, and it may be adhesively secured to the shank portion 14. If desired, the grip portion 16 may also be molded integrally with the shank member 14. The raised portions 18 of the grip are aligned directly with a lateral side edge portion 32 of the head member 12 or project from the handle to be disposed in a plane parallel to the ball engaging face as seen in FIG. 3. This requires the player to use the eastern forehand type of grip as shown in FIG. 1.

As previously discussed, in the preferred embodiment of the present invention the head portion 12 has a solid face 22 which may or may not be provided with the design 24 of a stringed racket printed or embossed thereon. The advantage of a solid face is that it generates greater wind resistance in the swing and closely simulates a heavier regulation tennis racket in which wind resistance is minimal due to the apertures between the rows of string. However, the overall reduced weight of the tennis trainer 10 encourages the player to utilize a greater amount of shoulder action in his swing and a proportionally lesser amount of wrist action as he may otherwise tend to do with a standard weight tennis racket.

Optimum benefit may be derived from the tennis trainer when it is used in conjunction with a light weight game ball 34 having the same basic size and bounce characteristics of a standard tennis ball. A suitable ball would not be heavy enough to break window glass nor damage walls or furniture and would be substantially less noisy than a regulation ball. One such ball is a soft foam practice tennis ball made from cold cured high resiliency polyether type of polyurethane foam and sold commercially under the trademark All Ball and manufactured by Tennis Resources, Inc.

For the purpose of minimizing the chance of losing the companion game ball 34 during periods when the tennis trainer 10 is not in use, a retaining clip 36 is provided which may be snapped over the handle 14 and be adapted to securely retain the ball 34. As shown in FIG. 1, the retaining clip 36 may be of generally FIG. 8 configuration having open ends and with a shank-receiving portion 38 and a ball-retaining portion 40. The clip 36 may be made of a slightly flexible, non-frangible material, such as spring steel or suitable plastic, e.g., polyvinyl chloride. The clip 36 is snapped around the shank 14 and the ball 34 is compressibly inserted in the ball-retaining portion 40 which may be provided with a larger diameter suitable to the deformation characteristics of the particular ball used. When the tennis trainer 10 is being used, it is contemplated that the retaining clip 36 be removed from the shank 14 in order to preserve the proper balance feature of the trainer.

From the foregoing description of the invention, it is seen that there is provided a practice tennis training device 10 of lightweight and sturdy construction including a head portion 12, handle 14 and grip 16, having the overall length, width and shape of a standard tennis racket. The weight of the tennis trainer is distributed so as to be proportional to the weight distribution of a regular tennis racket and, in conjunction with the orientation of the finger placement guides 18 provided on the grip 16, the practitioner is forced to utilize more shoulder action as opposed to excessive wrist action in his swing pattern, thereby conditioning himself in proper tennis form. When used together with a lightweight spongy game ball 34, the tennis trainer 10 may be used indoors with any convenient wall as a backboard. A convenient storage feature is provided in a nature of a detachable retaining clip 36 which may be snapped over the handle 14 of the tennis trainer 10 and which has a portion 40 adapted to receive the game ball 34.

The embodiments of the invention in which an exclusive property or privilege is claimed are defined as follows:

1. A tennis training device for use with a ball made of soft plastic foam, the combination comprising; a head member of relatively low density rigid plastic foam material having oppositely facing substantially imperforate ball engaging surfaces spaced apart in substantially parallel relation to each other and being of a size and shape substantially identical to that of a conventional stringed tennis racket, said head member being substantially imperforate, and a handle member of a relatively higher density material than said head member, said ball engaging surfaces being spaced apart a distance greater than the largest cross sectional dimension of said handle member, said handle member being attached to said head member in the space between and parallel to said ball engaging surfaces, said head and handle members having weights substantially equal to each other and providing a balance substantially the same as that of a conventional stringed tennis racket and a total weight substantially less than the weight of a conventional tennis racket, said substantially imperforate surfaces causing air resistance during swinging of said device simulating the swing of a conventional stringed tennis racket and thereby encouraging the use of a greater amount of shoulder action and less wrist action than with a heavier conventional stringed tennis racket.

2. The combination of claim 1 wherein said handle member has a grip portion, said grip portion including finger placement guides projecting from said grip portion and disposed in a plane parallel to the ball engaging surfaces of said training device.

3. The combination of claim 1 and further comprising a retaining clip detachably attached to said handle member and adapted to detachably receive and retain a ball relative to said handle member.

* * * * *